United States Patent [19]

Hyduke

[11] Patent Number: 4,973,090

[45] Date of Patent: Nov. 27, 1990

[54] METHOD AND MEANS OF SECURING, SHORTENING AND DRAWING OBJECTS TOGETHER USING A KNOT

[76] Inventor: Nicholas Hyduke, 1701 E. 8th St. Apt 121, Tempe, Ariz. 85281

[21] Appl. No.: 326,881

[22] Filed: Mar. 21, 1989

[51] Int. Cl.[5] ..... D04G 5/00; B65H 69/04

[52] U.S. Cl. ..... 289/1.2; 289/1.5

[58] Field of Search ..... 289/1.2, 1.5, 18; 24/115 H, 129 R

[56] References Cited

U.S. PATENT DOCUMENTS

| | | | |
|---|---|---|---|
| 1,598,310 | 8/1926 | Quinlan | 289/1.5 |
| 3,223,440 | 12/1965 | Rosenzweig | 289/1.2 |
| 3,307,864 | 3/1967 | Rosenzweig | 289/1.2 |

FOREIGN PATENT DOCUMENTS

| | | |
|---|---|---|
| 1285980 | 1/1961 | France . |
| 1462917 | 1/1966 | France . |

OTHER PUBLICATIONS

*The Ashley Book of Knots,* Clifford Ashley, Garden City, New York, 1946, pp. 220, 221, 406.

*Primary Examiner*—Werner H. Schroeder
*Assistant Examiner*—Michael A. Neas
*Attorney, Agent, or Firm*—Ralph R. Barnard

[57] ABSTRACT

A method of binding material with a knot including: drawing a continuous lace of binding material around the material to be bound so that two separate draw points are formed, tying the continuous lace of material initially in a half-knot with two equal subloops for bringing the two draw points together, additionally tying a double-loop bow-knot in the continuous lace of material wherein the midpoint of the continuous lace of material is located substantially in the center portion of the knot and the acme of each box loop is comprised substantially of the first and third quarter points of the original continuous loop.

9 Claims, 1 Drawing Sheet

METHOD AND MEANS OF SECURING, SHORTENING AND DRAWING OBJECTS TOGETHER USING A KNOT

FIELD OF THE INVENTION

This invention relates generally to the field of tying knots and more particularly securing, shortening and drawing objects together in the performance of a multitude of tasks using knots in the binding material.

BACKGROUND OF THE INVENTION

Using the prior art techniques, binding material in the form of lace, line, string, rope, cable, ribbon or any other kind of material in the furtherance of utility of drawing and binding items together such as clothing, etc. use binders having two free ends. This is true of the draw strings in sweatcloths, and all sorts of other clothes, as well as the laces of shoes. The field in which binders are used is manifold. However, the common problems of using binders with two free ends to draw the binding laces and draw points together and securing the laces together in the form of a knot are that the more secure the knot, the tighter the knot must be and the harder it is to untie when the need arises and conversely, if tied too loosely, the free ends allow the possibility of the knot being inadvertently loosened or untied. Articles of clothes use lace binders in all forms and the lace has two free ends. When a knot is tied in the two free ends the tighter you draw the free ends against the two draw points and add a very tight knot the harder it is to untie the same or alternatively, the looser the knot is tied, the easier it is for the knot to come undone. Moreover, since there are two free ends there is a greater likelihood that one or more of the free ends will recede through an eyelet at the draw point or draw points when the knot is untied causing further problems. If the binder material were not composed of two free ends, these problems would not occur. However, most of the knots used in the prior art would not be usable to serve as a method of first drawing the draw points together and then securely knotting the binder together for the purpose of securing, shortening, and drawing objects together, using a knot that will not be inadvertently untied, but that will be untied easily when so desired.

SUMMARY OF THE INVENTION

This invention has the advantage of using these principles in combination with a newly discovered knot creating technique which allows the user to form a secure knot while offering the option of undoing the knot swiftly and with minimal resistance and at the same time have the binder material between the two draw points be a continuous lace of material.

Accordingly, it is a primary objective of the present invention to teach a new and improved method of securing, shortening, and drawing objects together using a knot.

Another object of the present invention is to teach a new and improved method of securing, shortening, and drawing objects together with continuous lace of binding material using a new and improved knot.

Another object of the present invention is to teach a new and improved method of securing, shortening, and drawing objects together with continuous lace of binding material using a new and improved knot containing one bow of two loops and an identifiable point at which the knot can be untied by the withdrawal of one or both loops of a bow through the center of the knot.

Another object of this invention is to introduce a bow-knot in a continuous lace of binding material which will not be untied by pulling either or both of the two resultant bow loops.

Another object of this invention is to introduce a bow-knot in a continuous lace of binding material whose loops, either together or separately, can be used as handles to carry the object secured. It might be noted here that the continuous lace of material used as the starting point to tying said knot can likewise be used for carrying objects in the starting continuous condition of being unknotted.

Another object of this invention is to introduce a method of creating two apertures in a bow-knot by tying a new and improved knot in a continuous line of binding material by which objects could be suspended without the possibility of having those objects released by way of movement or weight releasing the knot.

Another object of the present invention is to teach a new and improved method of tying a knot without utilizing loose ends of a strand of binding material so that the knot would avoid the hazards of the dangling "free" ends of material, with the resultant insecurity of the knot and eventual degradation of the ends of the binding material.

Another objective of the teachings of the present invention is to offer an alternative knot wherever a conventional bow-knot would have been appropriate, such as tying shoestrings or securing the waist of a garment which is secured by tying an appropriate lace of material.

Another objective of the teachings of the present invention is to allow manufacturers and eventual users of various items which could have been secured by using conventional knots from the possibility of inadvertently separating the lace material used to bind the draw part of the article of clothes from the article of clothes when manipulating the article of clothes. For example, the draw string will not disappear into the sweatpants waist. This is accomplished because the knot outlined herein allows for the manufacture of garments or footwear, etc., with a fastening binding material which is continuous and without loose ends, thereby eliminating the possibility that the fastening agent can be separated from the draw part of the article, such as the piece of clothing.

BRIEF DESCRIPTION OF THE FIGURES

These and other objectives, features and advantages of the present invention should become apparent from the following description when taken in conjunction with the accompanying drawings in which.

FIGS. *3a* & *3b* show the effect of pulling the material as described above after releasing the cross point and holding the material so that two interim loops would be formed. After successfully beginning to pull the material through the space described above let the cross point loose and hold an opposite end of the material flowing through that space. The result is the creation of a half-knot close to the origin of the material and a free flowing lace of material which allows for the manipulation of the size of the two interim loops.

Figure 4:
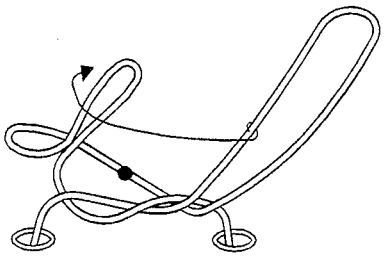

FIG. 4 shows both interim loops extended with a sub-loop formed in one interim loop and with a section of the opposite interim loop encircling this sub-loop. The sub-loop must be created by using material closest to the draw point.

Figure 5:
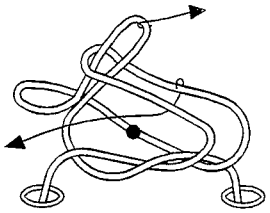

FIG. 5 shows a section of the interim loop opposite the half-knot being pulled through that space created where the sub-loop is crossed by a section of the interim loop.

Figure 6:
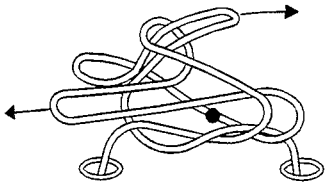

FIG. 6 shows the resultant two sub-loops being pulled through the spaces created to form the two final loops of the bow-knot.

Figure 7:
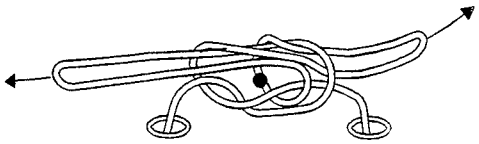
Figure 8:
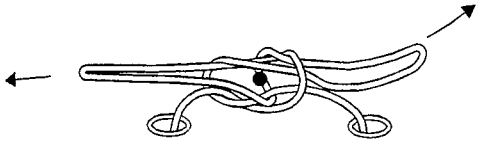
Figure 9:
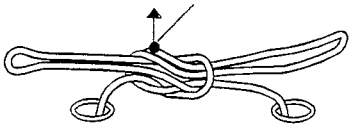

FIGS. 7, 8 and 9 show the final knot at various stages of being tightened, with FIG. 9 indicating the section to pull to release the knot.

DETAILED DESCRIPTION OF THE INVENTION

The final product of this invention is a bow-knot following a half-knot. The qualities of this knot which are unique are the ability to release the knot in a quick and easy fashion and the ability to tie this knot in a closed loop lace of material such that said knot will not be untied by pulling either or both loops of the resultant bow-knot.

To tie this knot the individual need only have a closed loop of material which could take the form of a continuous circle of material or a loop of material originating from two separate draw points.

Continuous material as used herein means a lace, a line, a string, a rope, a cord, a cable, and all the alternatives forms of binding means which may be used to bring draw points together. The draw points may be the eyelets of shoes, corsets, or the draw string access holes for sweatpants, sweatshirts, dresses, trousers, sweaters, hoods of coats, hats, etc.. In some instances the lace, line, rope, cable, passes through the draw points into the sweatpants, dresses, trousers, hoods of coats, etc., in the form of a continuous line, binder, lace, string inside the article with respect to which the draw points are connected and sometimes the lace line rope string, etc., is attached to the article in the vicinity of the draw points. The important feature is that the draw points are connected by a continuous lace of material for securing, shortening and drawing objects and articles of clothing together.

The teachings of the present invention relate to the new and improved knot and method for making the same described herein.

Figure 1:
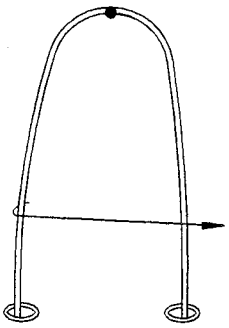
FIG. 1 shows the continuous lace between two draw points which is the starting point for creating the new and improved knot of the present invention.

Specifically, the teachings of the present invention relate to a lace of continuous material running between two draw points by drawing the continuous material tight between the two draw points. Reference is made to FIG. 1 where the draw points are shown as two eyelets such as would be found in a shoe, sweatpants, sweatshirt, etc.

Figure 2:
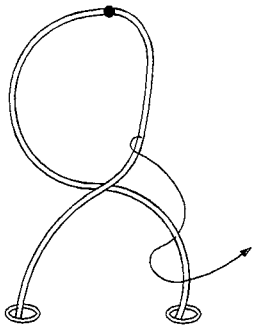
FIG. 2 shows the continuous lace of FIG. 1, being rotated in its entirety for 180 degrees. Continue to move one portion of the oval formed by the portion of the material above the point at which the material crosses in the same direction until such portion can be folded down and through that space.
Figure 3A:
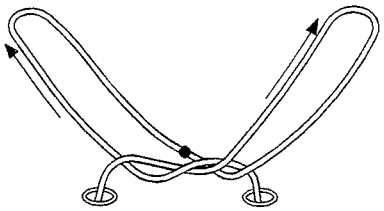
Figure 3B:
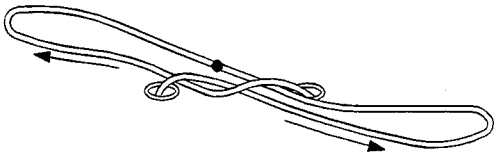

The teachings of the invention relate to drawing the two draw points together by creating a half-knot by the manipulation of the continuous lace as shown if FIGS. 2, 3*a* and 3*b*. The acme of the lace is shown by the darkened point which appears in each of the figures, but is defined by FIG. 1, as the mid point of the original loop. In one mode for tying the knot the left side of the loop is crossed over in front of (front being the side facing the tyer) the right side of the loop near the draw points and holding the laces together with the left hand where they cross over the upper part of the loop just above where it crosses the right side of the loop is (as shown if FIG. 2) taken over, behind, and brought forward under the right side of the loop between the cross over and the right draw point, forming (as shown in FIG. 3*a*) a half-knot between the two sides of the loop near the draw points and (as shown in FIG. 3*b*) with the remainder of the material in the continuous loop running out from each side of the half-knot and joined under the half-knot that has been drawn tight against the continuous material to form two loops one on each side of the halfknot, that are adjustable in length, slack in one loop being taken up by increasing the length of the other loop by sliding the continuous material under the half-knot, and drawing up said two loops in said half-knot tight so as to bring the two draw points together to the desired location and tension. Thereafter, to utilize the two loops to form a bow-knot (as shown in FIGS. 4,5,6,7,8,9), holding the part of each loop that comes off the half-knot, a bow-knot is tied between the two sides by using the part that comes off the half-knot as a standing end (as in the prior art of tying a bow-knot with two free ends of a lace of material) and then pulling each loop of the resultant bow until all the slack in the continuous material of the knot is taken up by the two loops. The loops of the bow-knot made in accordance of the teachings of the present invention are connected in such a way that if the proper part of the knot is pulled, i.e. that part of the bow-knot where the loops are joined by continuous material, the bow-knot and the half-knot are untied and the continuous lace of material returns to its original condition of being unknotted.

The method identified in the proceeding paragraph could be labeled a right hand method of tying the new and improved knot according to the teachings of the present invention. However, if the word left is inserted for the word right in the paragraph above the method identified could be described as a left hand method of tying the new and improved knot according to the teachings of the present invention.

The final product of this invention is a bow-knot following in a half-knot. The qualities of this knot which are unique are the ability to release the knot in a quick and easy fashion and the ability to tie this knot in a closed loop of material such that said knot will not be untied by pulling either or both loops of the resultant bow-knot.

To tie this knot the individual need only have a closed loop of material which could take the form of a continuous circle of material or a loop of material originating from two separate draw points, as shown in FIG. 1.

This loop is extended so that the material in which the knot will be created is taught, as shown in FIG. 1. Then rotate the original form of loop 180 degrees, as shown in FIG. 2. This motion forms a point at which the material crosses, preferably closer to the point of origin of the draw points.

Then, if one visualizes this interim form of a loop as a four part figure, with the cross, referred to above, indicating the midpoint of the four sections, and they further being delineated by the two draw points and the acme of the figure, hold this form at the point at which these sections cross, grasp an upper portion of the form, and maneuver one portion of the upper section, as shown in FIG. 2, down and through the space formed between the draw points and the cross now being held by the person manipulating the material. Continue to pull the form in the way described herein until a half-knot with two loops is formed, as shown in FIG. 3*a* and 3*b* which loops are interim in form, said half-knot being stationary and temporarily securing the draw points. An identifying feature of this half-knot in continuous material is that the points of intersection between the interim loops which is furthest from the half-knot is free moving, and when each interim loop is manipulated in size so that they are equal or nearly so, on the face of the knot, the acme of the original loop is centered, said point eventually being the point at which the resultant bowknot will be untied.

Then split one interim loop into two loops by pinching a section of material to form same, then fold the section of the unaltered interim loop nearest the half-knot around this pinched section of material. This will create a triangle of material consisting of those portions immediately originating from the half-knot. Reach through this section and pull that portion of the interim loop through this triangle that has a common connection to that portion of the continuous loop which is free-moving. Then continue to pull each of these "newly" formed loops until the material supporting them is exhausted.

Pull until tight and the knot is complete. What is created is a half-knot held secure by a bow-knot. The knot can be released by pulling the section of the continuous material connecting the loops of the resultant bow, which will dominate the face of the knot. This section can be accentuated by coloring or the installation of a device attached to or encircling the continuous material, as a bead, which can act as an aid to untying the knot.

Another method describing the teachings of the present invention includes describing as an improved method of securing, shortening, or drawing objects together with a continuous lace of material running between first and second draw points and tying a bow-knot with a knot tied using the following method:

(a) using an unbroken lace of material from the first draw point to the second draw point to form a loop, as shown in FIG. 1;

(b) rotating said loop for 180 degrees, as shown in FIG. 2, so that the two sides of the loop cross forming a smaller upper loop;

(c) holding the point at which the cross is formed and continuing by drawing a point on a half-section of the upper loop down and through that portion of the original loop below the cross until two interim loops are formed by then holding the remaining half-section, as shown in FIG. 3*a;*

(d) pulling the two interim loops to tighten the draw points until the acme of the original loop is brought up to but not under the half-knot and the resulting two interim loops are of equal size, and the desired level of tension applying force to the draw points is exerted by the half-knot, as shown in FIG. 3*b;*

(e) the half-knot being formed by those two portions of the continuous lace of material which have their origin in closest proximity to the original draw points;

(f) pinching the portion of one of the interim loops to form a sub-loop that is on the half-section thereof closest to the half-knot, as shown in FIG. 4;

(g) holding said sub-loop and pulling the other interim loop so that a portion which is closest to the half-knot encircles the said sub-loop, as shown in FIG. 5;

(h) pulling the portion of the opposite interim loop furthest from the half-knot through the hole formed by the two draw points and the point at which the material crosses;

(i) pulling both sub-loops to tighten the knot forming a complete double-loop bow-knot, as shown in FIGS. 7 & 8.

The improved method as described, teaches that the knot formed thereby is released and untied by pulling said continuous lace of material at approximately its original acme or the corresponding point on the adjacent directly connected portion of the continuous lace.

The teachings of the present invention include many facets, including:

(A) A method of tying a knot in lace of material that was originally a continuous strand of material with two draw points, so that a knot as described herein can be tied without having to make use of a loose end of material, said knot having the quality of being able to be tightened and held securely by action of a half-knot prior to being secured by creating a bow-knot.

(B) A method of tying a knot with a string or other piece of material after having secured the two loose ends of a length of material, either by securing the material to a surface by mechanical or chemical means, so that the material is anchored to the surface, or by creating a physical impediment to the free movement of the material in the material itself so that a portion of the material is anchored to the surface, and tying said knot without the use of the original free ends of the material.

(C) A method of tying a knot comprising a half-knot formed at the draw points in a given piece of material acting as the foundation for a bow-knot which said bow-knot acts both as the mechanism by which the original half knot is held taught and as the mechanism by which the knot can be untied.

(D) A method of shortening, or removing the excess or slack from a continuous rope or other material by tying a knot consisting of a half-knot secured by a bow-knot.

(E) A method of tying a secure knot in a closed loop of material, said knot being adjustable and able to be untied in a fashion that does not require a release of pressure upon that portion of the knot drawing portions of a body together or binding portions of a body together.

(F) A method of tying a secure knot in a closed loop of material in which said knot will not be untied by pulling apart the draw points of the object.

(G) A method of securing, shortening or drawing objects together with a draw string or lace which can not be lost in object such as clothing beyond the draw points because the draw string is continuous and unbroken.

(H) The method of tying a knot as taught herein is particularly enhanced by the fact that one can put a marker such as coloring or tag of any color or form at the mid point of the original loop of continuous material or a device of any form that encircles the lace of continuous material between the two draw points, as a marker to help adjust the size of the loops in the course of tying the knot as taught herein and at the same time to identify the point on the continuous material where the knot can be pulled so as to release and untie the knot with ease.

(I) The method of tying a knot as taught herein is enhanced by the fact that the final bow loops can be pulled out either singly or at the same time and may in fact be used as apertures for holding items associated with the task of securing, shortening and drawing objects together.

(J) The method of tying a knot as taught herein is enhanced by the fact that there are no loose ends of a strand of material that can become frayed or provide the hazards and insecurity of dangling free.

(K) The method of tying a knot as taught herein is enhanced by the fact that the continuous lace or draw string of material can never be lost by being pulled through an aperture or draw point.

The foregoing description has been directed to particular embodiments of the invention in accordance with the requirements of the Patent Statutes for the purposes of illustration and explanation. It will be apparent, however, to those skilled in this art that many modifications and changes will be possible without departure from the scope and spirit of the invention. It is intended that the following claims be interpreted to embrace all such modifications.

I claim:

1. A knot comprising:

(a) a continuous lace of material from draw point to another draw point;

(b) said knot being tied in said continuous lace of material being initially a continuous loop drawn from said draw points then being formed into a half-knot with two equal subloops for bringing the two draw points together;

(c) said knot being tied in said continuous lace of material thereafter adding a bow-knot wherein the midpoint of the continuous lace of material is located substantially in the center portion of the know and the acme of each bow loop is comprised substantially of the first and third quarter points of the original continuous loop.

2. An improved method of securing, shortening, or drawing objects together with a continuous lace of material running between first and second draw points and tying a bow-knot with a knot tied using the following method:

(a) using an unbroken lace of material from the first draw point to the second draw point to form a loop, as shown in FIG. 1;

(b) rotating said loop for 180 degrees, as shown in FIG. 2, so that the two sides of the loop cross forming a smaller upper loop;

(c) holding the point at which the cross is formed and continuing by drawing a point on a half-section of the upper loop down and through that portion of the original loop below the cross until two interim loops are formed by then holding the remaining half-section, as shown in FIG. 3*a;*

(d) pulling the two interim loops to tighten the draw points until the acme of the original loop rests adjacent to the formed half-knot and the resulting two interim loops are of equal size, and the desired level of tension applying force to the draw points is exerted by the half-knot, as shown in FIG. 3*b;*

(e) the half-knot being formed by those two portions of the continuous lace of material which have their origin in closest proximity to the original draw points;

(f) pinching the portion of one of the interim loops to form a sub-loop that is on the half-section thereof closest to the half-knot, as shown in FIG. 4;

(g) holding said sub-loop and pulling the other interim loop so that a portion which is closest to the half-knot encircles the said sub-loop, as shown in FIG. 5;

(h) pulling the portion of the opposite interim loop through the hole formed by the two draw points and the point at which the material crosses;

(i) pulling both sub-loops to tighten the knot forming a complete bow-knot, as shown in FIGS. 7 & 8.

3. The improved method of claim 2 wherein the knot formed thereby is released and untied by pulling said continuous lace of material at approximately its original acme or the corresponding pint on the adjacent directly connected portion of said continuous lace.

4. A method of tying a knot in a continuous lace of material comprising of the following steps:

(a) using an unbroken lace of material form the first draw point to the second draw point to form a loop;

(b) rotating said loop for 180 degrees, so that the two sides of the loop cross forming a smaller upper loop;

(c) holding the point at which the cross is formed and continuing by drawing a point on a half-section of the upper loop down and through that portion of the original loop below the cross until two interim loops are formed by then holding the remaining half-section;

(d) pulling the two interim loops to tighten the draw points until the acme of the original loop rests adjacent to the half-knot and the resulting two interim loops are of equal size, and the desired level of tension applying force to the draw points is exerted by the half-knot;

(e) the half-knot is formed by those two portions of the continuous line of material which have their origin in closest proximity to the original draw points;

(f) pinching the portion of one of the interim loops to form a sub-loop that is on the half-section thereof closest to the half-knot;

(g) holding said sub-loop and pulling the other interim loop so that a portion which is closest to the half-knot encircles the said sub-loop;

(h) pulling the portion of the opposite interim loop through the hole formed by the two draw points and the point at which the material crosses;

(i) pulling both sub-loops to tighten the knot forming a complete bow-knot;

5. The improved method of claim 4 wherein the knot formed thereby is released and untied by pulling said continuous lace of material at approximately its original acme or the corresponding point on the adjacent directly connected portion of said continuous lace.

6. A method of securing, shortening, or drawing objects together with a continuous material running between two draw points by drawing the continuous material tight between the two draw points and tying a bow-knot in the continuous material comprising the following steps:

(a) continuous material is drawn or formed into a loop between two draw points;

(b) left side of loop is crossed over in front of the right side of loop near the draw points and, holding the laces together with the left hand where they cross-over, the upper part of the left side of the loop, just above where it crosses the right side, is taken over, behind, and brought forward, under the right side of the loop between the cross-over and the right draw point, forming a half-knot between the two sides of the loop near the draw points, and with the remainder of the material in the continuous loop running out from each side of the half-knot and joined under the half-knot that has been drawn down tight against the continuous material to form two loops, one on each side of the half-knot, and that are joined by the continuous material under the half-knot, and that are adjustable in length, slack in one loop being taken up be increasing the length of the other loop because the continuous material slides freely under the half-knot, (c) holding the part of each loop that comes off the half-knot, a bow-knot is tied between the two sides using the part of each loop that comes off the half-knot as a standing end; and (d) pulling each loop of the resultant bow until all slack material in the continuous material is taken up by the bow.

7. The method of claim 6 wherein the combination half-knot and bow-knot is untied by pulling at a point on the continuous material in the knot which connects the continuous material of the bow-loops.

8. A method of securing, shortening, or drawing objects together with a continuous material running between two draw points by drawing the continuous material tight between the two draw points and tying a bow-knot in the continuous material comprising the following steps:

(a) continuous material is drawn or formed into a loop between two draw points;

(b) right side of loop is crossed over in front of the left side of loop near the draw points and, holding the laces together with the right hand where they cross-over, the upper part of the right side of the loop, just above where it crosses the left side, is taken over, behind, and forward, under the left side of the loop between the cross-over and the left draw point, forming a half-knot between the two sides of the loop near the draw points, and with the remainder of the material in the continuous loop running out from each side of the half-knot and joined under the half-knot that has been drawn down tight against the continuous material to form two loops, one on each side of the half-knot, that are joined by the continuous material under the half-knot, that are adjustable in length, slack in one loop being taken up be increasing the length of the other loop because the continuous material slides freely under the half-knot, (c) holding that part of each loop that comes of the half-knot, a bow-knot is tied between the two sides using the part of each loop that comes off the half-knot as a standing end; and (d) pulling each loop of the resultant bow until all slack material in the continuous material is taken up by the bow.

9. The method of claim 8, wherein the combination half-knot and bow-knot is untied by pulling at a point on the continuous material in the knot which connects the continuous material of the bow-loops.

* * * * *